US005423659A

United States Patent [19]

Thompson

[11] Patent Number: 5,423,659

[45] Date of Patent: Jun. 13, 1995

[54] SHROUD SEGMENT HAVING A CUT-BACK RETAINING HOOK

[75] Inventor: Ralph J. Thompson, Tolland, Conn.

[73] Assignee: United Technologies Corporation, Hartford, Conn.

[21] Appl. No.: 235,584

[22] Filed: Apr. 28, 1994

[51] Int. Cl.[6] ..... F01D 25/28

[52] U.S. Cl. ..... 415/173.1; 415/139; 416/192; 416/189

[58] Field of Search ..... 415/173.1, 139; 416/189, 191, 192

[56] References Cited

U.S. PATENT DOCUMENTS

| | | | |
|---|---|---|---|
| 3,365,172 | 1/1968 | McDonough et al. . | |
| 3,583,824 | 6/1971 | Smuland et al. | 415/117 |
| 4,013,376 | 3/1977 | Bisson et al. . | |
| 4,311,432 | 1/1982 | Kildea . | |
| 4,573,865 | 3/1986 | Hsia et al. . | |
| 4,573,866 | 3/1986 | Sandy, Jr. et al. | 415/116 |
| 4,650,394 | 3/1987 | Weidner | 415/115 |
| 4,650,395 | 3/1987 | Weidner | 415/116 |
| 4,655,044 | 4/1987 | Dierberger et al. . | |
| 4,752,184 | 6/1988 | Liang | 415/116 |
| 4,759,687 | 7/1988 | Miraucourt et al. | 415/127 |
| 4,897,021 | 1/1990 | Chaplin et al. | 415/139 |
| 4,992,025 | 2/1991 | Stroud et al. . | |
| 5,088,888 | 2/1992 | Bobo | 415/170.1 |
| 5,127,793 | 7/1992 | Walker et al. | 415/173.1 |
| 5,141,401 | 8/1992 | Juenger et al. | 416/219 R |
| 5,165,847 | 11/1992 | Proctor et al. | 415/115 |
| 5,167,485 | 12/1992 | Starkweather | 415/115 |
| 5,169,287 | 12/1992 | Proctor et al. | 415/115 |
| 5,188,506 | 2/1993 | Creevy et al. | 415/173.1 |
| 5,205,115 | 4/1993 | Plemmons et al. . | |
| 5,211,534 | 5/1993 | Catlow | 415/173.1 |
| 5,219,268 | 6/1993 | Johnson . | |
| 5,333,992 | 8/1994 | Kane et al. | 415/173.1 |

*Primary Examiner*—Edward K. Look
*Assistant Examiner*—Michael S. Lee

[57] ABSTRACT

A shroud segment for a gas turbine engine includes a hook having an undercut surface. Various construction details are developed that provide a segment having a hook with minimized bending stress. In a particular embodiment, a shroud segment includes a plurality of hooks spaced along the leading and trailing edges of the shroud segment. Each of the plurality of hooks includes a positioning surface, a support surface and an undercut surface therebetween. The positioning surface defines the limits of axial movement of the shroud segment. The support surface reacts the radial loading on the shroud segment during operation of the gas turbine engine. The undercut surface is offset from the stator assembly to define the maximum length of the support surface.

8 Claims, 3 Drawing Sheets

SHROUD SEGMENT HAVING A CUT-BACK RETAINING HOOK

TECHNICAL FIELD

This invention relates to a shroud segment for a gas turbine engine, and more particularly a shroud segment retained to the stator structure of the gas turbine engine by one or more hooks extending from the shroud segment.

BACKGROUND OF THE INVENTION

A typical axial flow gas turbine engine includes a compressor, a combustor and a turbine spaced sequentially about a longitudinal axis. Working fluid entering the compressor engages a plurality of arrays of rotating blades. This engagement adds energy to the fluid. Compressed working fluid exiting the compressor enters the combustor where it is mixed with fuel and ignited. The hot gases exit the combustor and flow into the turbine. The turbine includes another plurality of arrays of rotating blades that extract energy from the flowing hot gases.

Many steps are taken to maximize the efficiency of the gas turbine engine. In the turbine, each rotating turbine blade includes an airfoil that is shaped to engage the flowing gases and efficiently transfer energy between the gases and the turbine blade. Immediately upstream of each array of turbine blades is a stationary array of vanes. The vanes orient the flow to optimize the engagement of the flow with the downstream turbine blades. Radially inward of the airfoil and extending between adjacent airfoils is an inner platform. The inner platform defines a radially inner flow surface to block the hot gases from flowing radially inward and escaping around the airfoil. A corresponding radially outer flow surface is defined by a turbine shroud. The outer flow surface is in close radial proximity to the radially outer tips of the airfoils to minimize the amount of fluid that flows radially outward of the airfoils.

A typical turbine shroud is made up of a plurality of arcuate segments that are circumferentially spaced to form an annular structure. Each segment includes a substrate, a flow surface extending over the substrate, and means to retain the segment to the stator assembly outward of the array of blades. There are two commonly used types of retaining means. The first is a rail that extends along an axial edge of the segment and extends outward from the substrate. The rail includes a lip that engages a slot in the stator assembly. The other type is a plurality of hooks spaced along an axial edge of the segment and also extending outward from the substrate. The hooks also engage a slot in the stator assembly to retain the segments. One advantage of the hooks is the flexibility of the segment that results from not having a rail extending the length of the segment. In effect, the hooks are a segmented version of the rail, with the space between adjacent hooks providing additional flexibility. A drawback to the hooks is that, comparatively, the hooks have to be larger in cross-section to support the same load as the rail. This larger size limits the flexibility gain in using hooks rather than rails.

An additional function of the rails and hooks is to properly position the segment axially within the stator assembly. For this purpose, the axially facing surfaces of the hooks or rails is used as an axial position limiting surface. These positioning surfaces cooperate with mating surfaces within the stator structure to define the limits of the axial motion of the segment.

During operation of the gas turbine engine, the flow surfaces of the segments are exposed to the hot gases flowing through the turbine. To accommodate the extreme temperature present within the turbine, the segment may be coated with an insulating layer, such as a thermal barrier coating, and cooling fluid may be flowed over the radially outer surface of the segment. The cooling fluid is typically fluid drawn from the compressor and which bypasses the combustion process. In order to ensure that the cooling fluid flows into the flow path, rather than hot gases flowing outward, the cooling fluid is at a higher pressure than the hot gases flowing over the flow surface of the turbine shroud. The higher pressure cooling fluid loads the segments with a radially inward directed force that is reacted by the retaining means.

The segment has a hot side and a relatively cool side and therefore a thermal gradient across the segment develops. This thermal gradient encourages the arcuate segment to flatten out or bend in the opposite direction from its installed shape. This deflection places additional loading on the retaining means.

The retaining means, whether hooks or rails, must be of sufficient size to accommodate the bending stresses produced within the retaining means by the radially directed forces on the segment. Obviously, the larger the size of the hook or rail required, the greater the weight of the segment and the lower the flexibility of the segment. In addition, the retaining means may have to extend outward to provide a positioning surface for the segment. In instances where the segment is required to fit within a stator assembly having set dimensions, such as a segment being back fit into a pre-existing gas turbine engine, the required extension of the hooks or rails may increase the axial length of the hooks or rails and thereby amplify the bending stress in the hook as a result of the larger moment arm.

The above art notwithstanding, scientists and engineers under the direction of Applicant's Assignee are working to develop lightweight, flexible shroud segments for gas turbine engines.

DISCLOSURE OF THE INVENTION

According to the present invention, a shroud segment includes a hook having a positioning surface, a support surface and an undercut surface extending between the positioning surface and the support surface. The positioning surface locates the shroud segment within the proper position to define the flow surface outward of the rotating blades. The support surface retains the shroud segment against forces urging the shroud segment inward towards the rotating blades. The undercut surface spaces the support surface away from the positioning surface.

As used herein, the term "hook" should be understood to refer to one of a plurality of hooks spaced along an edge of a segment or a single rail extending along the edge.

As a result of the offset or cut-back surface, the bending stress in the hook resulting from the forces being reacted by the support surface may be minimized. Minimizing the bending stress in the hook produces the advantage of a more lightweight and flexible shroud segment due to the ability to use a hook having smaller dimensions.

According to a specific embodiment of the present invention, the shroud segment includes a plurality of hooks, each of which having an axial positioning surface, a support surface, and an undercut surface therebetween. The support surface has a maximum length dimension X1 and the undercut surface has a length dimension X2. The plurality of hooks includes a first set disposed along the leading edge and a second set disposed along the trailing edge of the shroud segment. The plurality of hooks along each edge include a seal land engageable with a seal to block fluid flow between the shroud segment and the stator assembly. In addition, the engagement between the seal land and the seal axially positions the shroud segment within the limits of motion permitted by engagement between the positioning surface and the stator assembly. In another specific embodiment, the hooks have a tapered profile with the maximum width near the bend in the hook. This feature further reduces the weight of the hooks.

The length of the support surface is as short as possible subject to the constraint of providing sufficient surface to engage the stator assembly to react to radial forces urging the shroud segment inward towards the rotor assembly and to permit axial motion of the shroud segment within the limits defined by the positioning surface. The maximum length dimension X1 corresponds to the length of the support surface with the positioning surface engaged with the stator structure, i.e. the shroud segment moved as far axially as permitted by the positioning surface.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
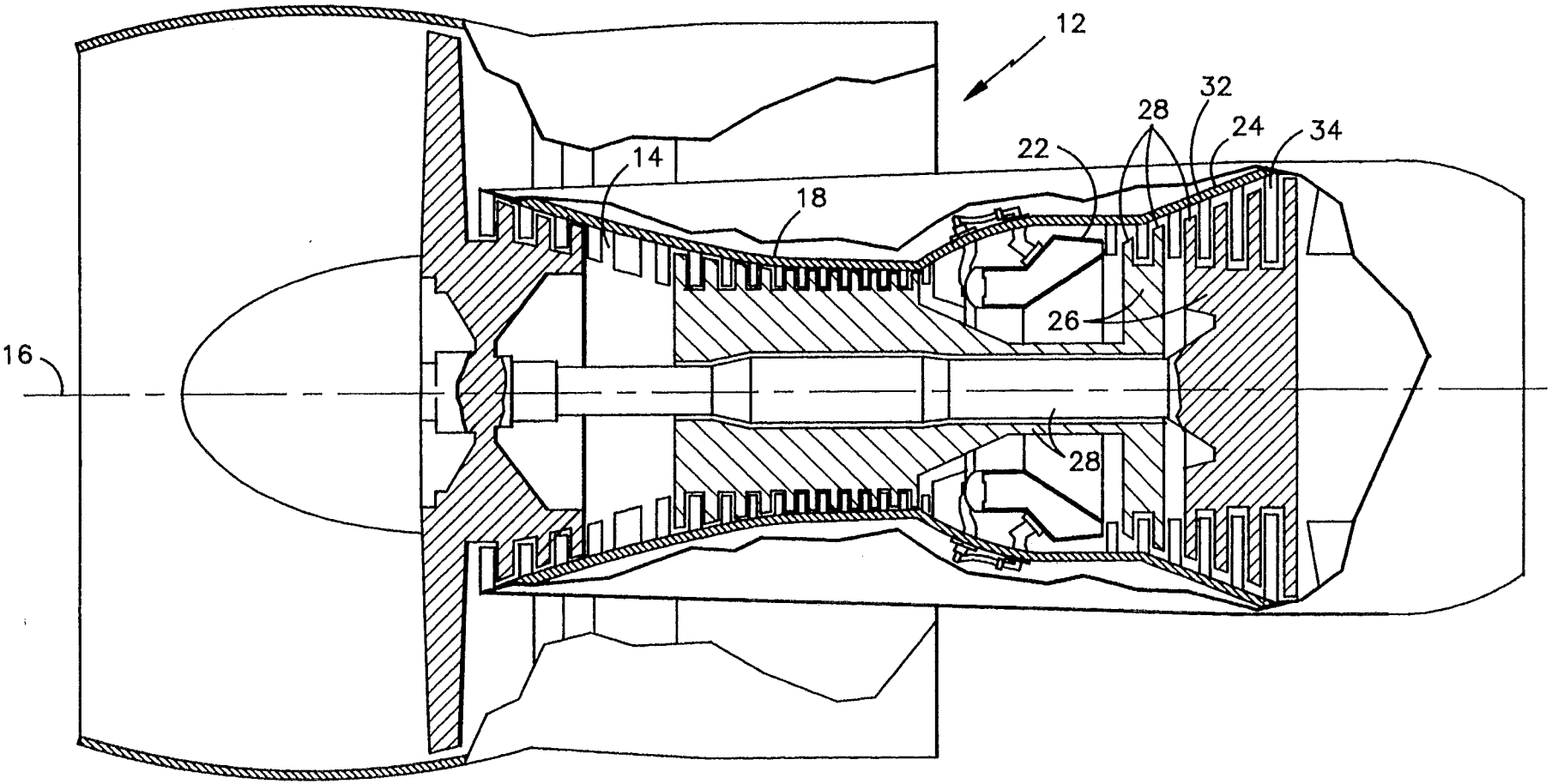
FIG. 1 is a sectional side view of an axial flow gas turbine engine.

Illustrated in FIG. 1 is an axial flow gas turbine engine 12 having an annular flow path 14 disposed about a longitudinal axis 16. The gas turbine engine 12 includes a compressor 18, a combustor 22, and a turbine 24. The flow path 14 flows sequentially through the compressor 18, combustor 22 and turbine 24. The turbine 24 includes a plurality of rotor assemblies 26 having rotor blades 28 extending through the flow path 14 and a stator assembly 32 having arrays of vanes 34, also extending through the flow path 14, immediately upstream of each rotor assembly 36.

Figure 2:
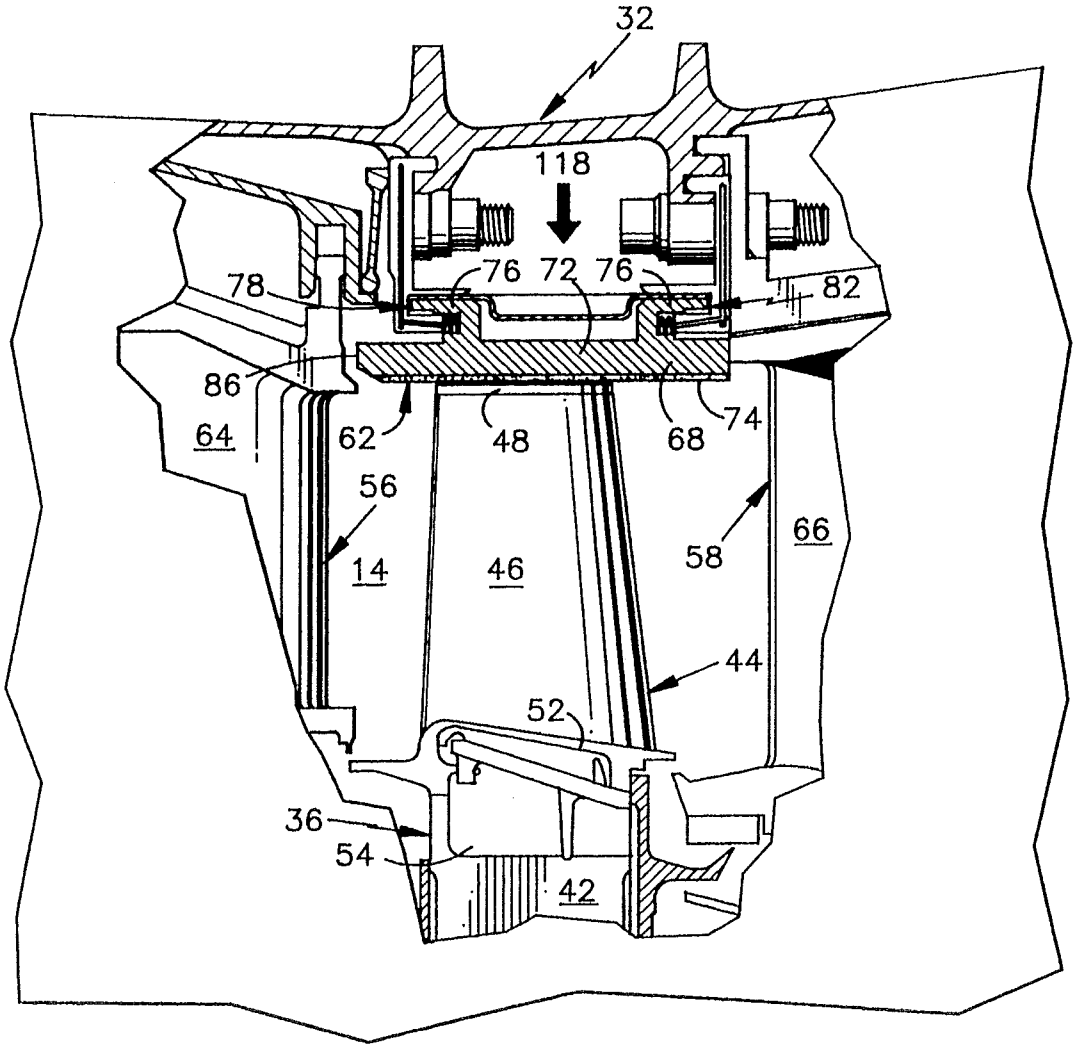
FIG. 2 is a side view, partially cut away, of a turbine illustrating an array of turbine blades and a turbine shroud.

FIG. 2 illustrates a rotor assembly 36 and the adjacent stator assembly 32. The rotor assembly 36 includes a rotating disk 42 and a plurality of rotor blades 44 extending from the disk 42. Each rotor blade 44 includes an airfoil 46 having an outer tip 48, an inner platform 52 extending laterally from the rotor blade 44, and a root portion 54 having means to attach the rotor blade 44 to the disk 42.

The stator assembly 32 includes an upstream, relative to the rotor assembly 36 in FIG. 2, array of vanes 56, a downstream array of vanes 58, and a turbine shroud. Each of the vanes 56,58 includes an airfoil 64,66 that engages the fluid flowing within the flow path 14 to orient the flowing fluid for optimal engagement with the rotor assembly 36 immediately downstream of the array of vanes 56,58.

The turbine shroud 62 includes a plurality of arcuate shroud segments 68 arranged circumferentially to define an annular structure. Each of the shroud segments 68 includes a substrate 72, a flow surface 74 facing into the flow path 14, and means 76 to retain the shroud segment 68 within the adjacent stator assembly 32 structure. The plurality of adjacent flow surfaces 74 define a radially outer flow surface for the flow path 14. The outer flow surface is in close radial proximity to the tips 48 of the rotor blades 46.

Figure 5:
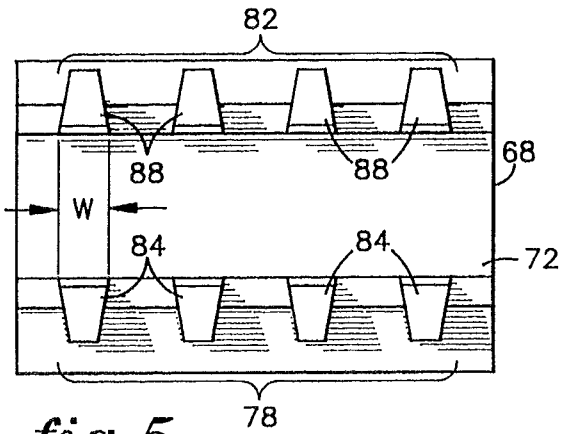
FIG. 5 is a top view of the turbine shroud segment.
Figure 3:
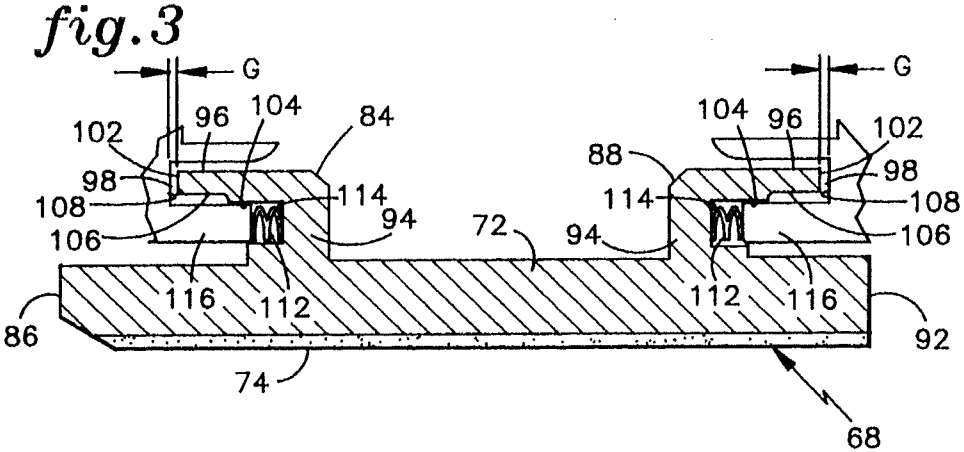
FIG. 3 is a sectional side view of a turbine shroud segment having a plurality of hooks.
Figure 4:
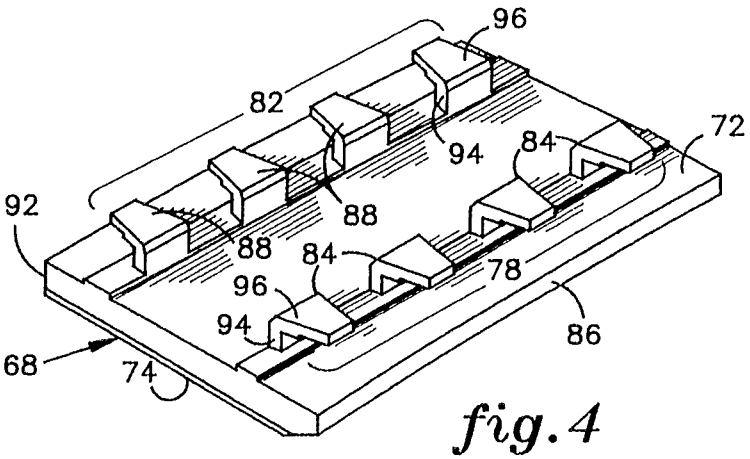
FIG. 4 is a perspective view of the turbine shroud segment.

The retaining means 76, as shown in more detail in FIGS. 3–5, is two sets of hooks 78,82. The first set 78 includes a plurality of adjacent hooks 84 extending along the leading edge 86 of the shroud segment 68. The second set 82 includes a plurality of adjacent hooks 88 extending along the trailing edge 92 of the shroud segment.

Each hook of the plurality of holes 84,88 has a first portion 94 extending radially outward from the substrate 72 and a second portion 96 extending axially from the first portion 94. Each of the second portions 96 is sized to engage with a slot 98 in the stator assembly 32 to radially retain the segment 68 against radially directed forces. The second portion 96 includes a positioning surface 102, a support surface 104, and an undercut surface 106. The positioning surface 102 faces axially towards a mating surface 108 of the stator assembly 32.

The plurality of positioning surfaces 102 along each edge 86,92 of the segment 68 in conjunction define means to restrict the movement of the segment 68 within axial limits. A gap G exists between each positioning surface 102 and its mating surface 108 such that the segment 68 may move forward and aft an amount equal to the axial length of the gaps G. The size of the gaps G is predetermined to limit the movement of the flow surfaces 74 of the shroud segments 68 such that the tips 48 are always in proximity to the flow surfaces 74.

The stator assembly 32 includes a pair of 'W' seals 112 engaged with a seal land 114 on the first portion 44 of each of the hooks 84,88. The 'W' seals 112 block fluid from flowing between the segments 68 and the adjacent stator structure 38. In addition, the 'W' seals 112 provide an axially directed spring force that urges the shroud segment 68 to remain located such that the gaps G between the positioning surfaces 102 and the mating surfaces 108 are maintained.

Figure 6:
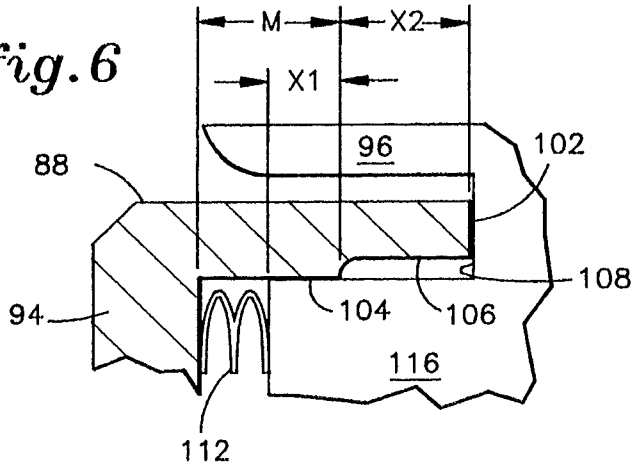
FIG. 6 is a side view of a hook in an extreme axial position relative to the stator assembly.

The support surface 104 engages an extension 116 of the stator assembly 32 to react any radially inward directed forces on the shroud segment 68. Such forces may be the result of cooling fluid flowing radially inward onto the outward side of the shroud segment 68. Since this fluid must be at a higher pressure than the fluid flowing within the flow path 14, a pressure differential exists that generates a force directed radially inward. The support surface 104 has a maximum length dimension X1, measured along the contact surface of the extension 116, that corresponds to the point at which the gap G for that hook 88 is minimal, i.e. that segment 68 is moved into the position causing maximum contact between the support surface 104 and the contact surface (see FIG. 6). In addition, the support surface 104 has a minimum length that is predetermined to be sufficient such that in either extreme axial position the segment 68 will not become disengaged from the stator structure 38.

The undercut surface 106 extends a distance X2 from the support surface 104 to the positioning surface 102 and spaces the two surfaces 102,104 apart axially. The undercut surface 106 is cut back from the support surface 104 such that, in an installed condition, the undercut surface 106 does not touch the contact surface of the extension 116. Therefore, the undercut surface 106 provides no radial support for the segment 68 and, as a result, the moment arm M for maximum bending stress within the hook 88 is defined by the maximum length of the support surface X1.

Referring now to FIG. 5, each hook 84,88 has a width dimension W that tapers outward from the first portion 94. This taper provides the maximum strength to react bending stress in the bend of the hook 84,88 and reduces the overall weight of the segment 68 by removing hook material in an area which it is unnecessary.

During operation, hot gases flow through the flow path 14 causing the shroud segment 68 to heat up. Cooling fluid is flowed radially inward (see arrow 118 in FIG. 2) onto the shroud segment to cool the segment 68 and maintain the temperature of the segment 68 within acceptable temperature limits. The high pressure cooling fluid flowing onto the segment 68 produces a force on the segment 68 directed radially inward. A temperature gradient results that causes the segment 68 to distort such that the arcuate segment 68 flattens out or arches in the opposite direction of its initial arcuate shape. This distortion of the segment 68 may produce additional forces on the hooks 84,88 that are directed radially inward. The support surface 104 reacts the forces that are directed radially inward to prevent the segment 68 from breaking loose from the stator assembly 32 and moving into the rotating blades 44.

Reacting the radial loads on the segments 68 results in bending stress within the hooks 84,88. This bending stress is dependent in pan upon the length of the support surface 104, i.e. the moment arm. By having the support surface 104 extend only the minimum length necessary to prevent the segment 68 from coming loose rather than the entire length of the second portion 96, this moment arm is minimized.

During use the segment 68 may be caused to move axially forward or aft. The positioning surfaces 102 prevent the segment 68 from excessive movement whereby the flow surface 74 may no longer be proximate the tips 48 of the rotating blades 44. To ensure that the positioning surfaces 102 may be properly located, and to prevent the length of the support surface 104 from becoming excessive such that the moment arm causes the bending stress within the hooks 84,88 to exceed the acceptable limits, the undercut surface 106 is placed between the support surface 104 and the positioning surface 102. As a result, the maximum length X1 of the support surface 104, and therefore the maximum moment arm M, may be minimized. Minimizing the length of the support surface 104 permits the plurality of hooks 84,88 to be sized to reduce weight and maximize flexibility of the segment 68.

The segments may be formed by casting or machining. Casting the segment is suggested as a cost effective method of forming the hooks or rails with the undercut surface.

Although illustrated in FIGS. 1 to 5 as a shroud segment having a plurality of hooks extending along the leading edge and trailing edge, it should be noted that an individual rail instead of the plurality of the hooks may be used along one or both edges, as desired. The rail, which is essentially a single hook extending along the edge of the segment, may have support surfaces spaced from positioning surfaces by an undercut surface in a similar fashion as the plurality of hooks illustrated in FIGS. 1 to 5.

Although the invention has been shown and described with respect with exemplary embodiments thereof, it should be understood by those skilled in the art that various changes, omissions, and additions may be made thereto, without departing from the spirit and scope of the invention.

What is claimed is:

1. A shroud segment for a gas turbine engine, the gas turbine engine including an annular flow path disposed about a longitudinal axis, a rotor assembly and a stator assembly, the rotor assembly including a rotating disk having a plurality of rotor blades extending radially outward from the disk and through the flow path, the stator assembly defining a radially outer flow surface outward of the rotor assembly and including the shroud segment, the shroud segment defining a portion of the outer flow surface and including at least one hook extending from the shroud segment, the hook engaging the stator assembly in an installed condition to retain the shroud segment, the hook including a first portion extending outward from the shroud segment and a second portion extending outward from the first portion, the second portion having a positioning surface engageable with the stator assembly to position the shroud segment relative to the stator assembly, a support surface engageable with the stator assembly to retain the shroud segment, and an undercut surface extending from the support surface to the positioning surface, the undercut surface being offset from the support surface such that during operation of the gas turbine engine the undercut surface is spaced away from the stator structure.

2. The shroud segment according to claim 1, wherein the first portion extends radially from the shroud segment and the second portion extends axially from the first portion relative to the installed condition, wherein the positioning surface axially locates the shroud segment within the stator structure, wherein the support surface retains the shroud segment within the stator structure in response to radially directed forces present during operation of the gas turbine engine, and wherein the undercut surface is radially spaced from the stator structure.

3. The shroud segment according to claim 1, wherein the first portion further includes a seal land engageable with a seal in the installed condition, the seal extending between the seal land and the stator structure to block fluid flow between the shroud segment and the stator structure, the seal spacing the first portion away from the stator structure such that the second portion extends over the seal in an installed condition to define a seal facing surface, the seal facing surface extending between the first portion and the support surface.

4. The shroud segment according to claim 1, wherein the shroud segment further includes a plurality of the hooks aligned along at least one edge of the shroud segment.

5. The shroud segment according to claim 4, wherein the plurality of hooks includes a first set disposed along the leading edge of the shroud segment and a second set disposed along the trailing edge of the shroud segment.

6. The shroud segment according to claim 1, wherein the axial portion of the hook has a width W, measured laterally relative to the axial and radial directions of the installed shroud segment, and wherein the second portion is tapered such that the width W of the second portion adjacent the first portion is greater than the width W of the second portion adjacent the positioning surface.

7. A shroud segment for a gas turbine engine, the gas turbine engine including an annular flow path disposed about a longitudinal axis, a rotor assembly and a stator assembly, the rotor assembly including a rotating disk having a plurality of rotor blades extending radially outward from the disk and through the flow path, the stator assembly defining a radially outer flow surface outward of the rotor assembly, the stator assembly including the shroud segment and a seal, the shroud segment defining a portion of the outer flow surface and including a plurality of hooks, the plurality of hooks including a first set disposed along the leading edge of the substrate and a second set disposed along the trailing edge of the substrate, each of the hooks extending from the shroud segment, the plurality of hooks engaging the stator assembly in an installed condition to retain the shroud segment, each of the hooks including a first portion extending radially from the shroud segment and a second portion extending axially from the first portion, the first portion having an axially facing seal land engageable with the seal in the installed condition wherein such engagement blocks fluid flow between the shroud segment and the stator assembly, the second portion having a positioning surface engageable with the stator assembly to axially position the shroud segment relative to the stator assembly, a support surface engageable with the stator assembly to radially retain the shroud segment, an undercut surface extending from the support surface to the positioning surface, and a seal facing surface extending between the first portion and the support surface, wherein the undercut surface is offset from the support surface such that during operation of the gas turbine engine the undercut surface is radially spaced away from the stator structure.

8. The shroud segment according to claim 7, wherein the second portion of the hook has a width W, measured laterally relative to the axial and radial directions of the installed shroud segment, and wherein the second portion is tapered such that the width W of the second portion adjacent the first portion is greater than the width W of the second portion adjacent the positioning surface.

* * * * *